US005146699A

United States Patent [19]

Lipford

[11] Patent Number: 5,146,699

[45] Date of Patent: Sep. 15, 1992

[54] AUGER DREDGE SPECIALLY ADAPTED TO REMOVAL OF TOXIC SEDIMENT

[75] Inventor: Keith W. Lipford, Pasadena, Md.

[73] Assignee: Ellicott Machine Corporation, Baltimore, Md.

[21] Appl. No.: 802,548

[22] Filed: Dec. 5, 1991

[51] Int. Cl.[5] ..... E02F 3/92

[52] U.S. Cl. ..... 37/57; 37/58; 37/71; 37/DIG. 18; 210/388

[58] Field of Search ..... 37/57, 58, 64, 66, 71, 37/DIG. 18; 210/388

[56] References Cited

U.S. PATENT DOCUMENTS 2,178,265 10/1939 Peterson ..... 37/71 X
3,440,742 4/1969 Goldstein ..... 37/57
4,312,762 1/1982 Blackburn et al. ..... 37/64 X
4,839,061 6/1989 Manchak et al. ..... 37/71 X
4,934,874 6/1990 Kleer et al. ..... 37/58 X
5,027,533 7/1991 Holt et al. ..... 37/DIG. 18

*Primary Examiner*—Randolph A. Reese
*Assistant Examiner*—Arlen L. Olsen
*Attorney, Agent, or Firm*—Oblon, Spivak, McClelland, Maier & Neustadt

[57] ABSTRACT

An auger dredge for removing toxic sediments wherein turbidity is minimized by attaching to the dredge a frame which first dislodges the material and feeds it to the auger for eventual transfer to a disposal site. Because the auger does not touch the dredged material directly turbidity which would otherwise be stirred up by the auger is vastly reduced.

13 Claims, 11 Drawing Sheets

AUGER DREDGE SPECIALLY ADAPTED TO REMOVAL OF TOXIC SEDIMENT

FIELD OF THE INVENTION

This invention relates to dredges and more particular to auger type dredges specially adapted to the removal of toxic sedimentary waste material.

BACKGROUND OF THE INVENTION

There are in various parts of the world ponds or former ponds which have been completely filled by hazardous chemical wastes discharged by nearby industrial plants. Often these ponds are adjacent to or actually communicate with waterways and an especially egregious example of such ponds are the so-called tar ponds of Sydney, Nova Scotia which have received for over 80 years the toxic discharge from coke ovens of an adjacent steel mill. The sediment in these ponds is thixotropic by nature and thick enough to sustain the weight of a man walking on the surface. Removal of this material by surface diggers and trucks is undesirable not only because of the spongy nature of the terrain but such digging can release into the air carcinogous matter existing in some ponds, e.g. the Sydney ponds, and known as polynuclear aromatic hydrocarbons (PAH's). The presence of an adjacent waterway suggests dredging as a solution but a cutter head dredge is not acceptable not only because of the dense nature of the sediment but because a cutter head dredge would cause excessive turbidity thereby contaminating the adjacent waterway for possibly miles beyond the dredging site. An auger type dredge is therefore suggested and one such dredge intended for substantially the same purpose as the present invention is disclosed in the U.S. patent to Blackburn et al. U.S. Pat. No. 4,312,762. There a longitudinally extending auger is thrust directly into the sediment to transfer the sediment axially to and through a dredge pipe for disposal at a remote site. A problem with this arrangement is that the exposed rotating auger head is bound to create turbidity in the surrounding water and though this may be acceptable in a landlocked pond it could be disastrous if the sediment contained flowable toxic matter and the pond had open access to a substantially uncontaminated waterway, or the sediment contained gaseous poisons such as PAH.

BRIEF DESCRIPTION OF THE INVENTION

The broad object of the invention is to provide a dredge especially adapted to the removal of toxic sediment with a minimum of dislodged sediment or poisonous products, e.g. PAH, either to the atmosphere or into surrounding waters.

The foregoing object is achieved by the use of a dredge module carried at the remote end of a ladder whose opposite end is pivoted to a shallow draft barge. The module comprises a shrouded transverse auger and a wedge shaped substantially open frame fixed to the front of the auger shroud and serving to first cut and receive the dredged material and then direct it against the auger whereby the auger, instead of acting directly on the face of the material being dredged resulting in possible excessive turbidity, acts on the material after it has been preliminarily dislodged and partially comminuted by the frame. The auger is designed to further comminute the material as the auger delivers it to a centrally disposed dewatering and pumping means for transport to a remote site.

Thus a more specific object of the invention is to provide an auger type dredge especially adapted to the dredging of toxic sediment by the use of a wedge shaped frame into which the material is first received before reaching the auger.

Other objects and their attendant advantages will become apparent as the following detailed description is read in conjunction with the accompanying drawings wherein.

Figure 8:
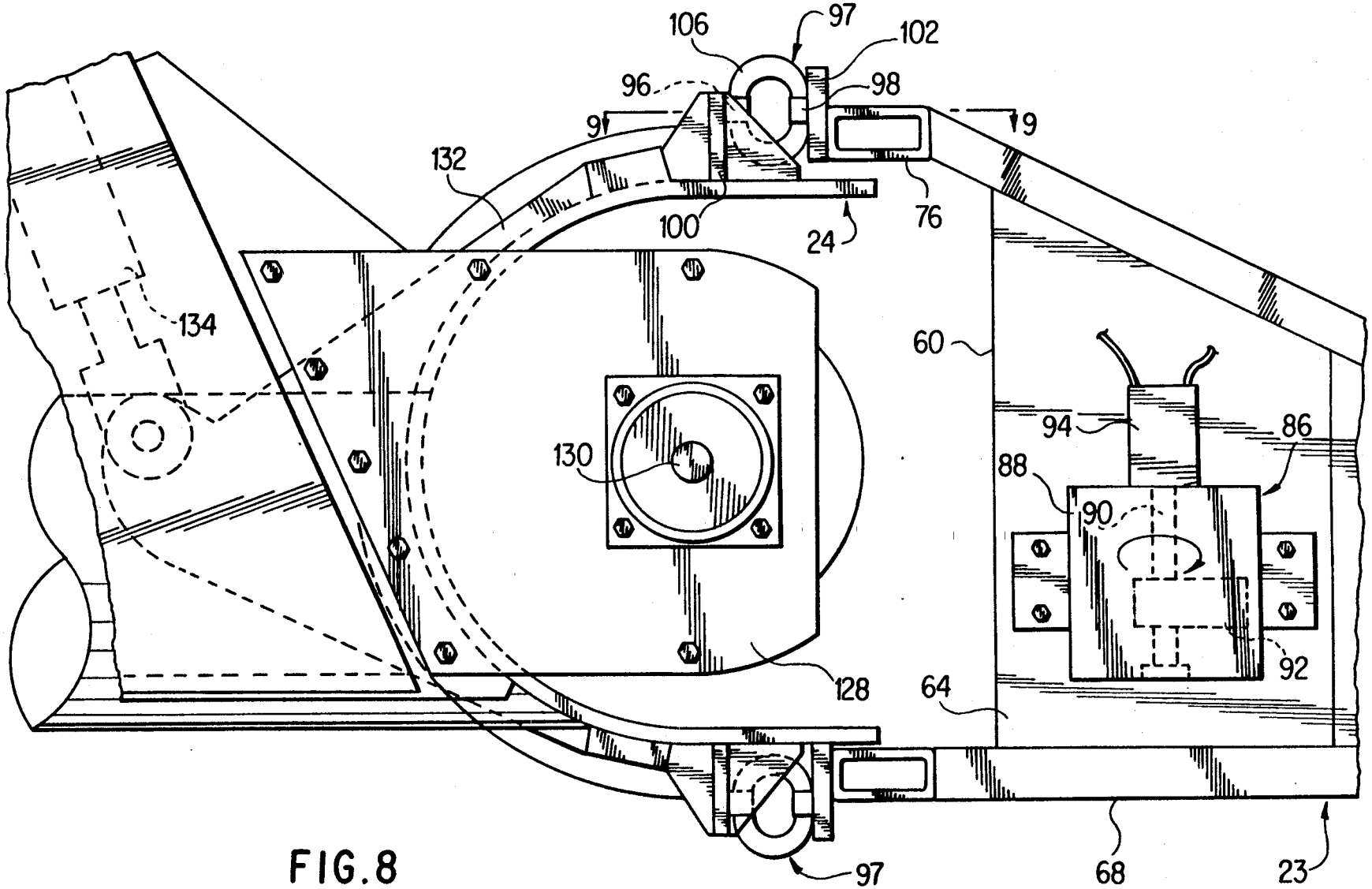
Figure 9:
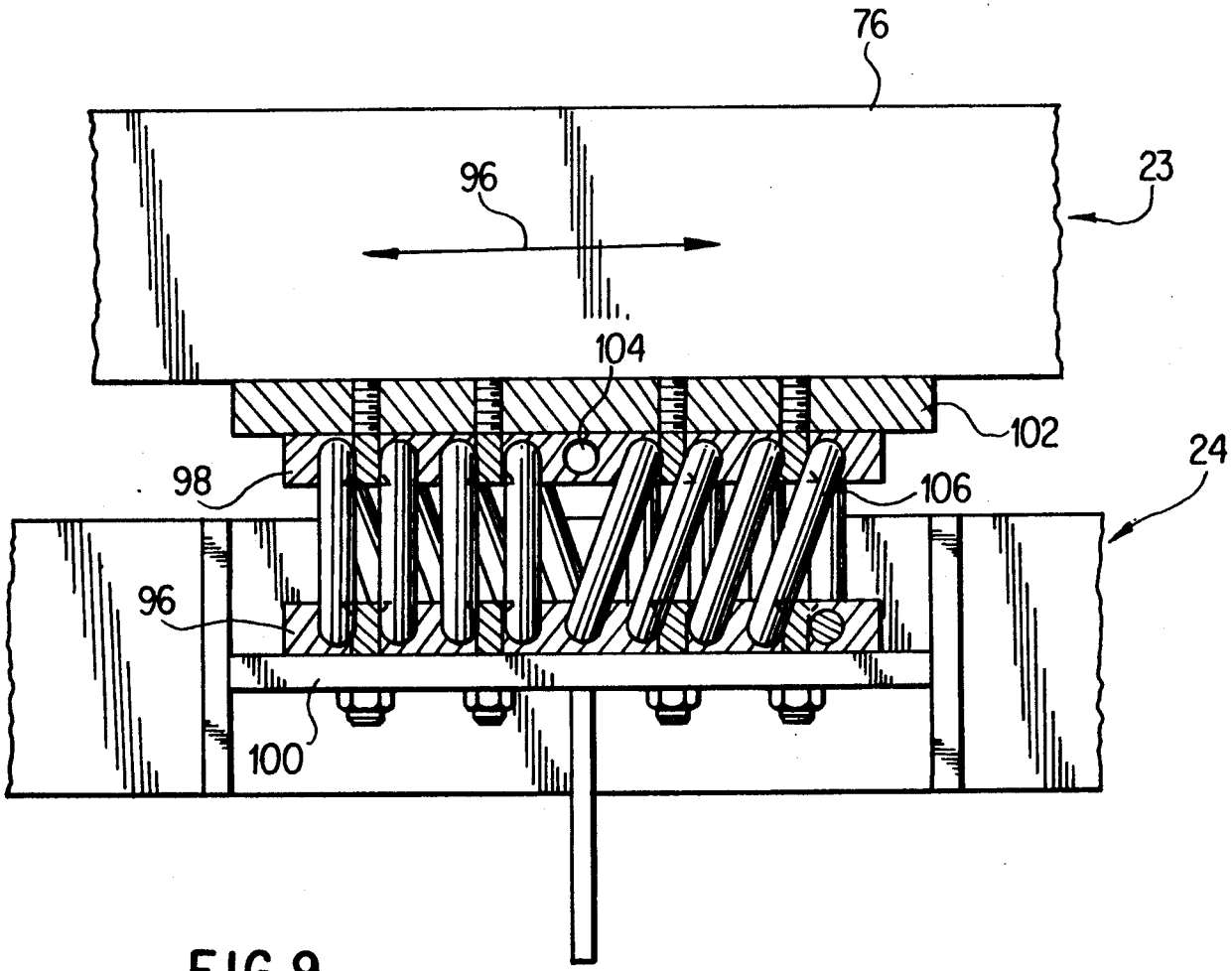
Figure 10:
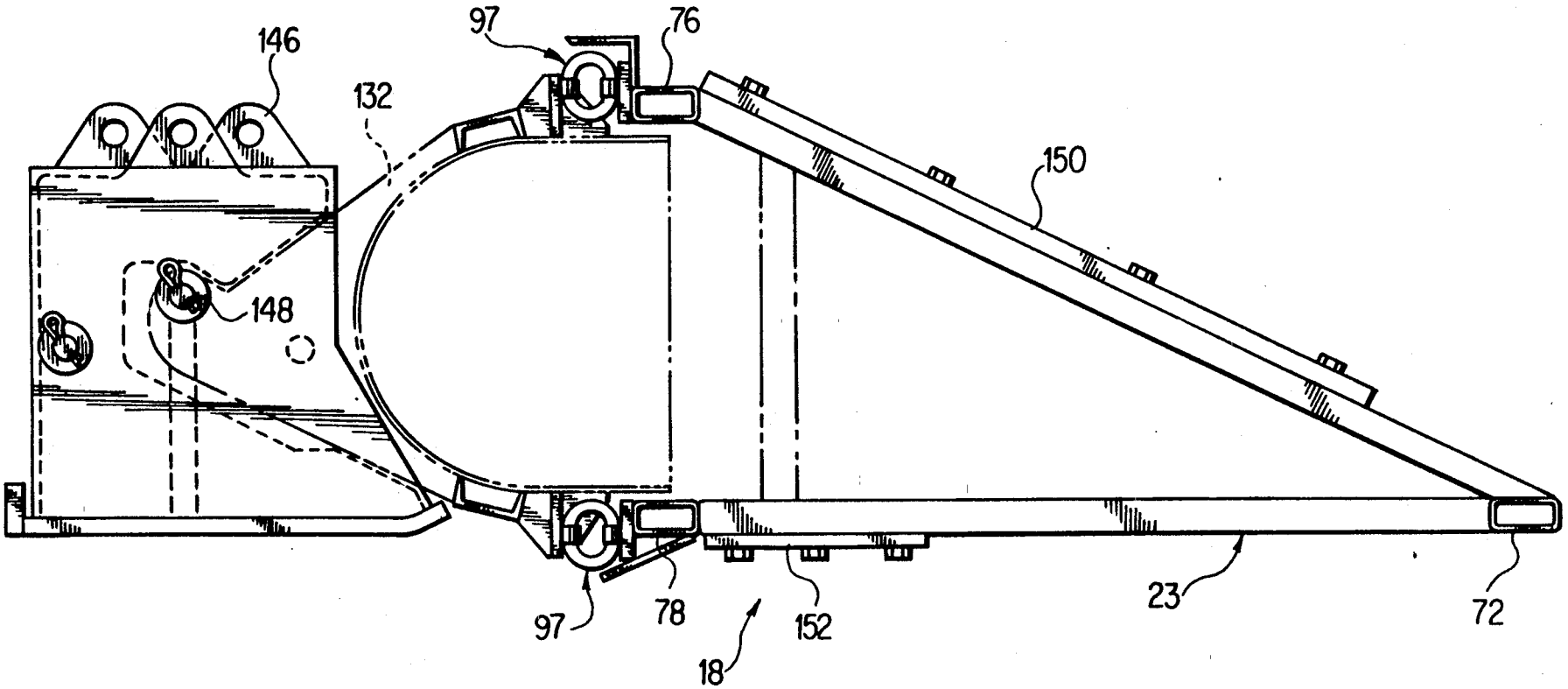

FIGS. *7a* and *7b* are horizontal change-position views, partly in plan and partly in section, showing the sludge pump of the present invention;

FIG. 8 is an enlarged broken elevational view of a part of the side of the dredge module of the present invention;

FIG. 9 is an enlarged horizontal cross sectional view taken substantially on the line 9—9 of FIG. 8 and showing one form of vibration isolation connector connecting the frame to the auger shroud; and FIG. 10 is a vertical side elevation partly in phantom and partly schematic showing counterweights which may be used with the dredge module of the invention.

DESCRIPTION OF THE PREFERRED EMBODIMENT

Figure 1:
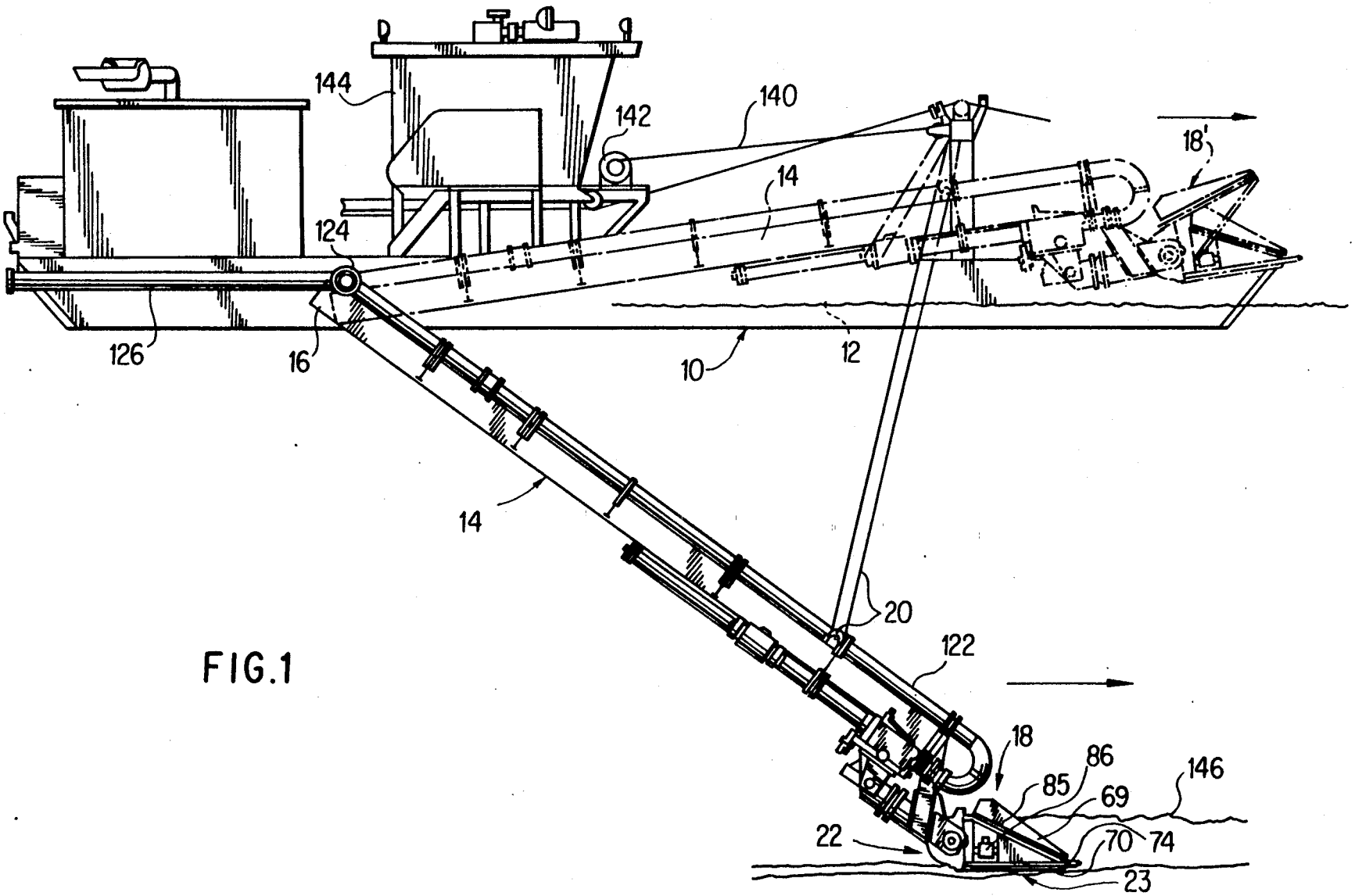
FIG. 1 is a side elevational view of a dredge barge showing in full lines a dredge ladder carrying a dredging module constructed in accordance with the invention and lowered to a working position, and in dashed lines the ladder and module raised to transport position.
Figure 2:
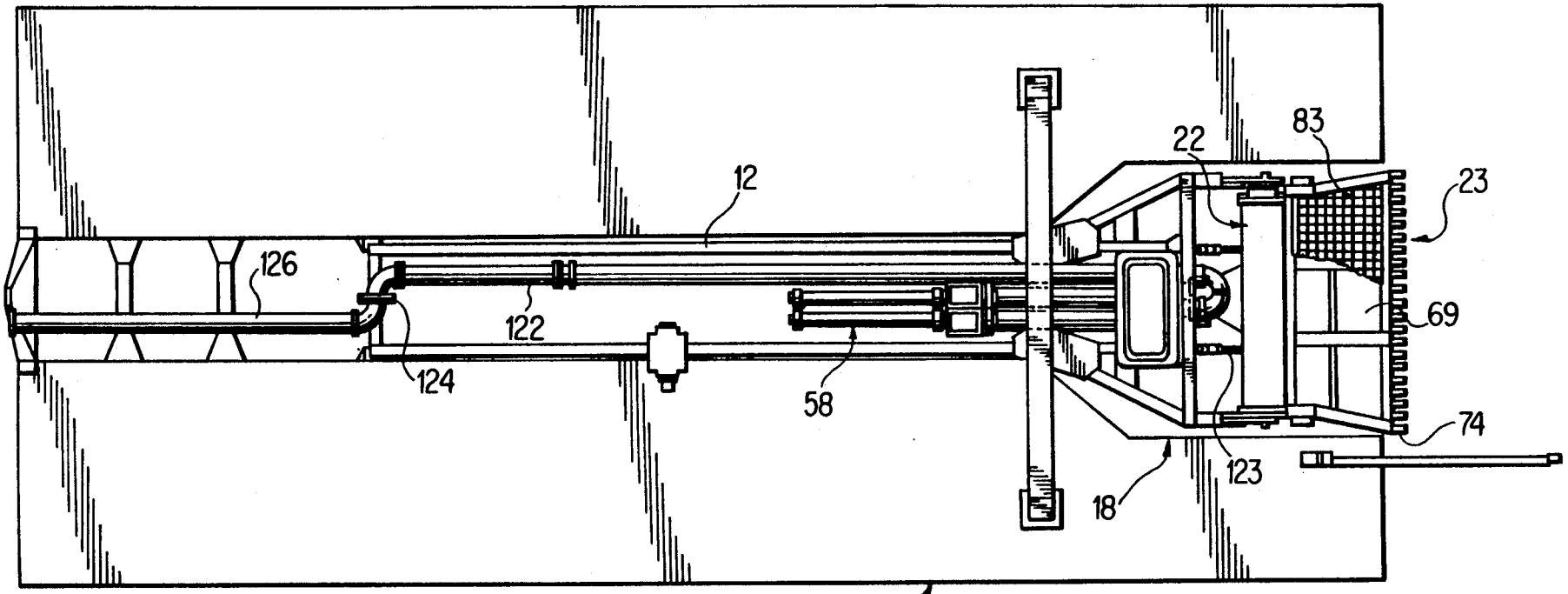
FIG. 2 is a top plan view of the barge of FIG. 1 showing the ladder in its raised transport position.
Figure 3:
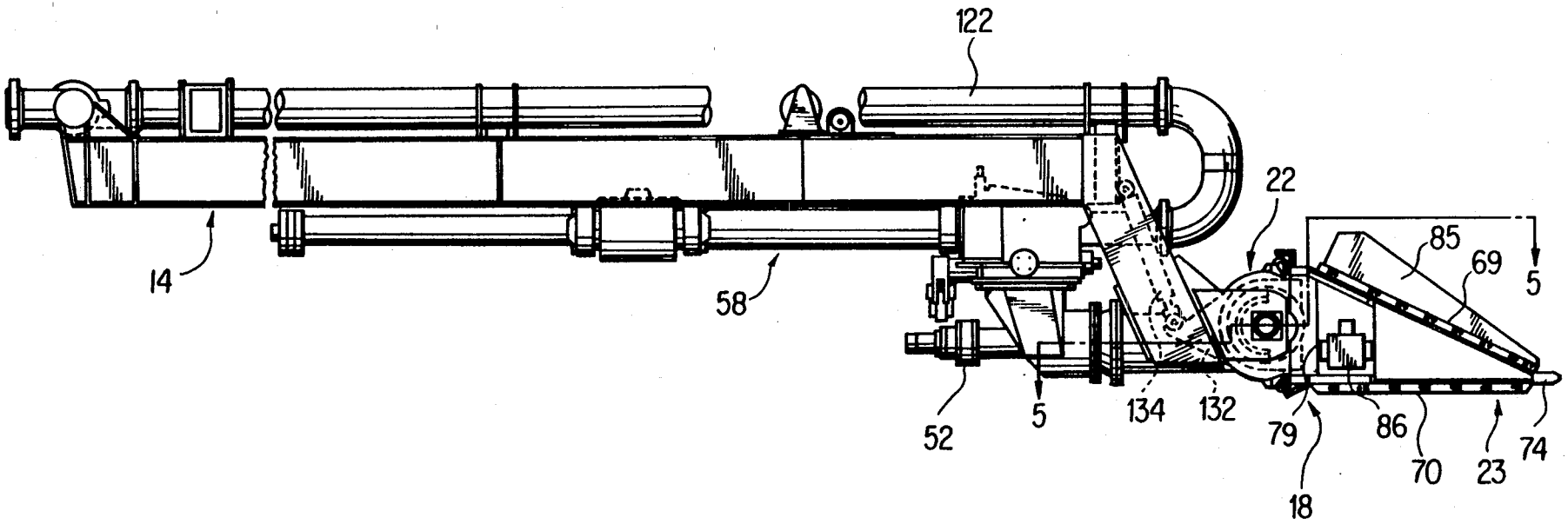
FIG. 3 is an enlarged side elevational view of the ladder of FIGS. 1 and 2.

Referring now to the drawings the numeral 10 refers to a shallow draft dredge barge having a slot 12 therethrough to accommodate a dredge ladder 14 pivoted at its inner end 16 to the closed end of the slot 12 and carrying at its remote end a dredge module generally designated by the numeral 18. The ladder is raised and lowered by conventional sheaves and falls generally indicated in FIG. 1 by the numeral 20. The solid lines in FIG. 1 show the ladder and module in working position and the dashed lines show these members in raised transport position.

Figure 5:
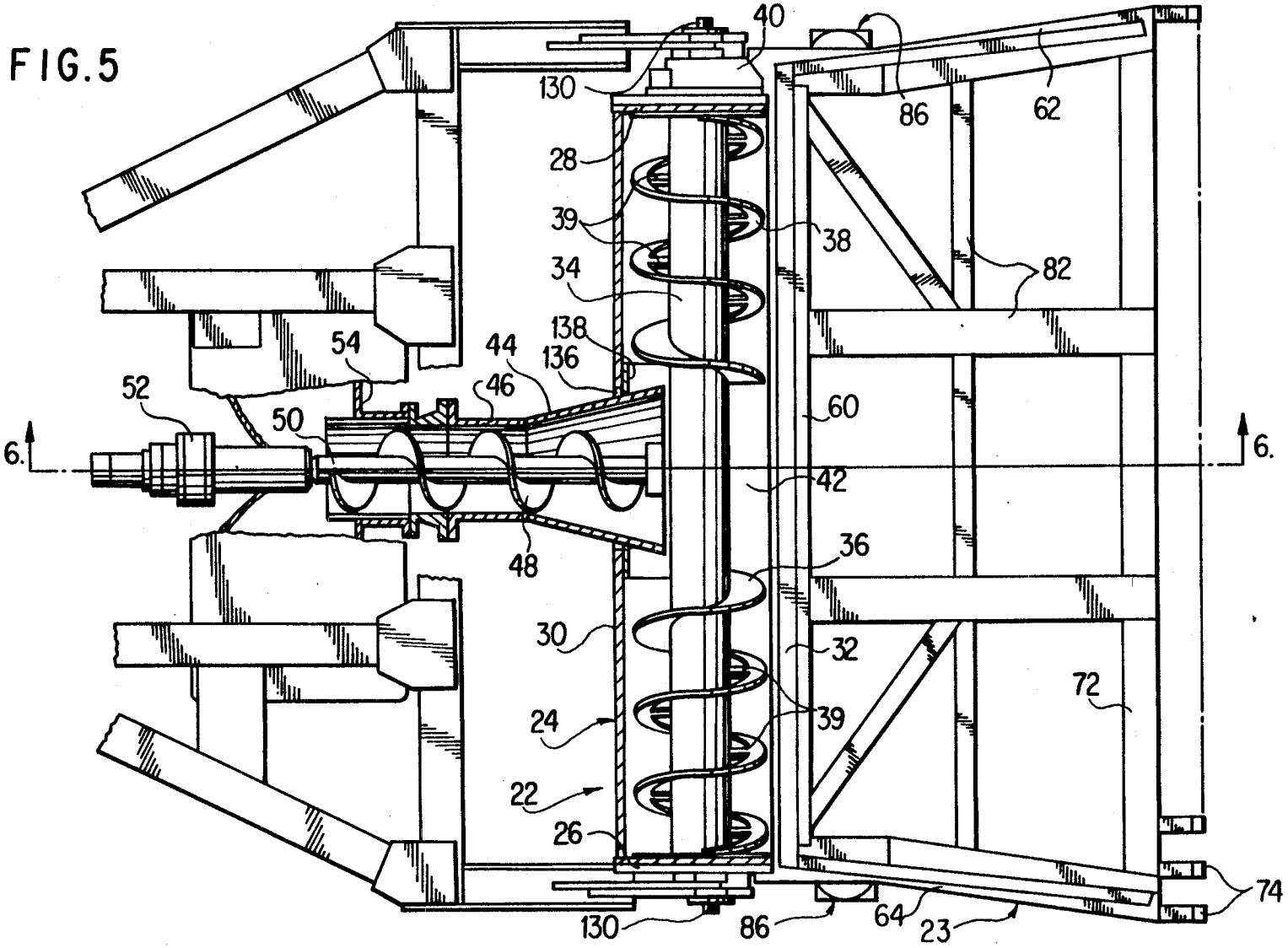
FIG. 5 is an enlarged horizontal cross sectional view taken substantially on the line 5—5 of FIG. 3.

The dredge module 18 comprises an auger dredge 22 and a wedge shaped frame 23. As best seen in FIG. 5, the auger dredge 22 comprises a shroud 24 having closed end walls 26, 28 and a substantially closed arcuate rear wall 30 having an open front 32. Journaled to the respective end walls 26, 28 of the shroud are the opposed ends of an auger shaft 34 carrying oppositely threaded auger blades 36, 38, at least a part of each of which is connected to the shaft by radial, helically spaced spokes 39 whose function is later described. An hydraulic motor 40 carried by the end wall 28 drives the shaft 34 in a direction to cause material engaged by the blades 36, 38 to be propelled towards a central region 42 of the shroud into which extends the flared end 44 of a passage 46 encompassing a transfer auger or feed screw 48 carried by a shaft 50 and driven in a proper direction by an hydraulic motor 52 to transfer material from the central region 42 of the shroud into a vertical passage 54 (FIG. 6) leading to the bottom of an inlet chamber 56 of a double acting, positive displacement pump generally indicated by the numeral 58 and hereinafter described in detail.

The wedge shaped frame 23 of the dredge module is open at its rear end 60 (FIG. 6) and has a pair laterally spaced vertical, outwardly flaring side walls 62, 64 (FIG. 5) whose upper and lower edges 66, 68 converge forwardly whereby the upper and lower faces 69, 70 of the frame terminate in a laterally extending cutting edge member 72 carrying a plurality of forwardly extending, laterally spaced digging teeth or tines 74. The frame 23 is constructed and arranged that when the module is in its operative position as generally shown in full lines in FIG. 1, the plane of the lower face 70 of the frame is substantially horizontal while the plane of the upper face 69 extends angularly upwardly and rearwardly from the cutting edge member 72. Rear horizontal laterally extending vertically spaced frame members 76, 78 (FIG. 6) define with the rear edges 79 of the frame side plates 62, 64 the rear opening 60 of the frame which is of substantially the same size as the open front 32 of the shroud. The frame member includes various flat structural member 82, best seen in FIG. 5, which are joined together with the side plates 62, 64 rear frame members 76, 78 and front cutting edge member 72 to form a rigid structure of great strength. Covering the upper and lower faces of the frame are screens 83, 84, respectively, and extending upwardly from the upper edges 66, 68 of the side plates 62, 64 are forwardly sloping outwardly flaring guide flanges 85.

As best seen in FIG. 8 the frame 23 carries on the outer face of each side plate 62, 64 a vibrator 86 of known construction comprising a housing 88 in which is pivotally journaled a vertical shaft 90 carrying an eccentrically mounted weight 92. The shaft 90 is driven by an hydraulic motor 94 to cause the eccentric weight to impart to the frame lateral vibrations as indicated by the double edge arrow 96 in FIGS. 4 and 9.

As best seen in FIGS. 8 and 9 the frame is connected to the shroud by vibration damping means 97 comprising a plurality of transversely spaced horizontal flanges 96 and 98 mounted on vertical structural members 100, 102, fixed to the front end of the shroud 24 and to the rear end of the frame 23, respectively. The respective flanges have transversely spaced vertical apertures 104 therethrough and screwed into these apertures are coil springs 106 as clearly seen in FIG. 9. These flanges and springs constitute the sole connection between the frame and shroud with the springs effectively isolating the auger portion 22 of the module from the frame portion 23.

Figure 6:
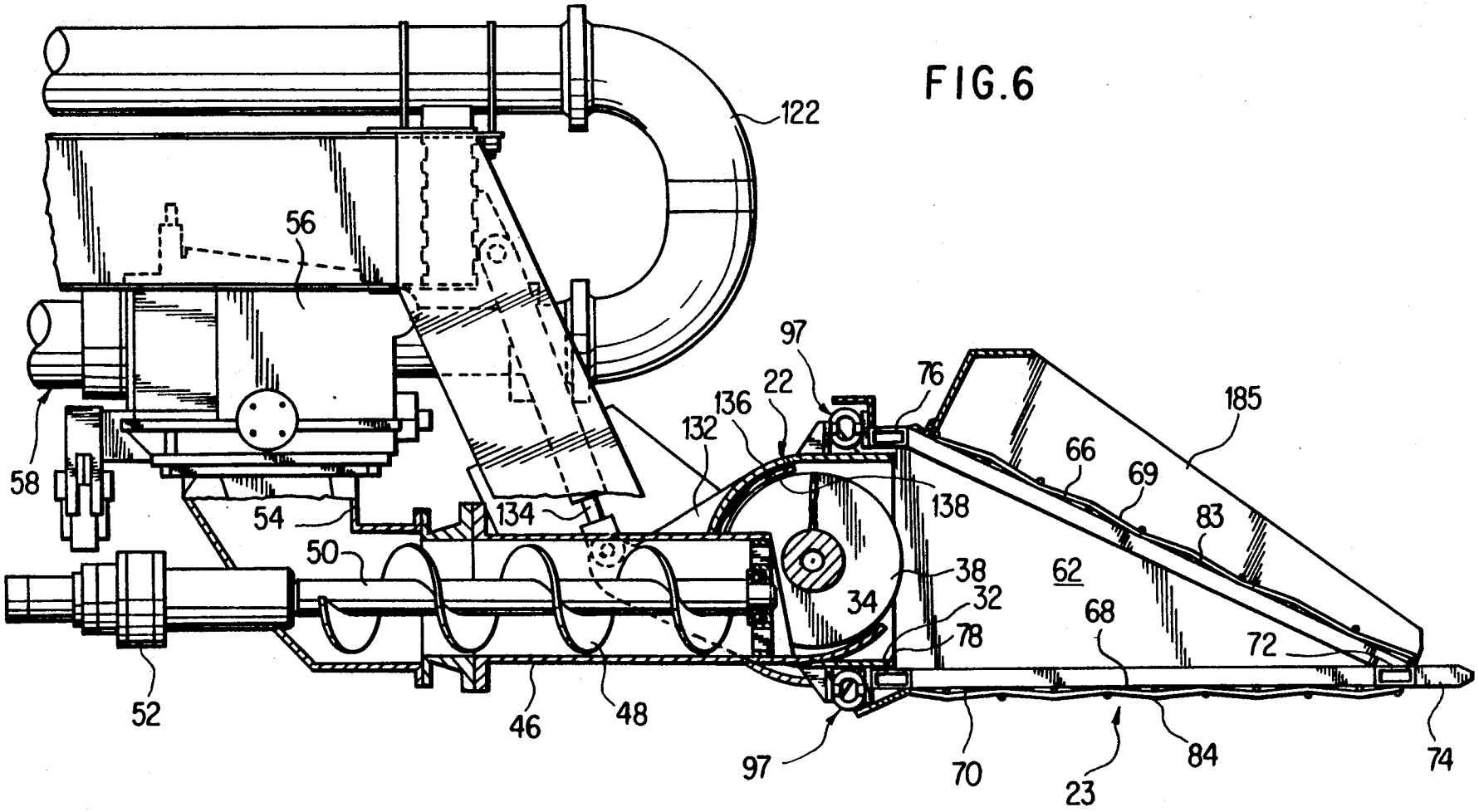
FIG. 6 is a vertical cross sectional view taken substantially on the line 6—6 of FIG. 5.
Figure 7A:
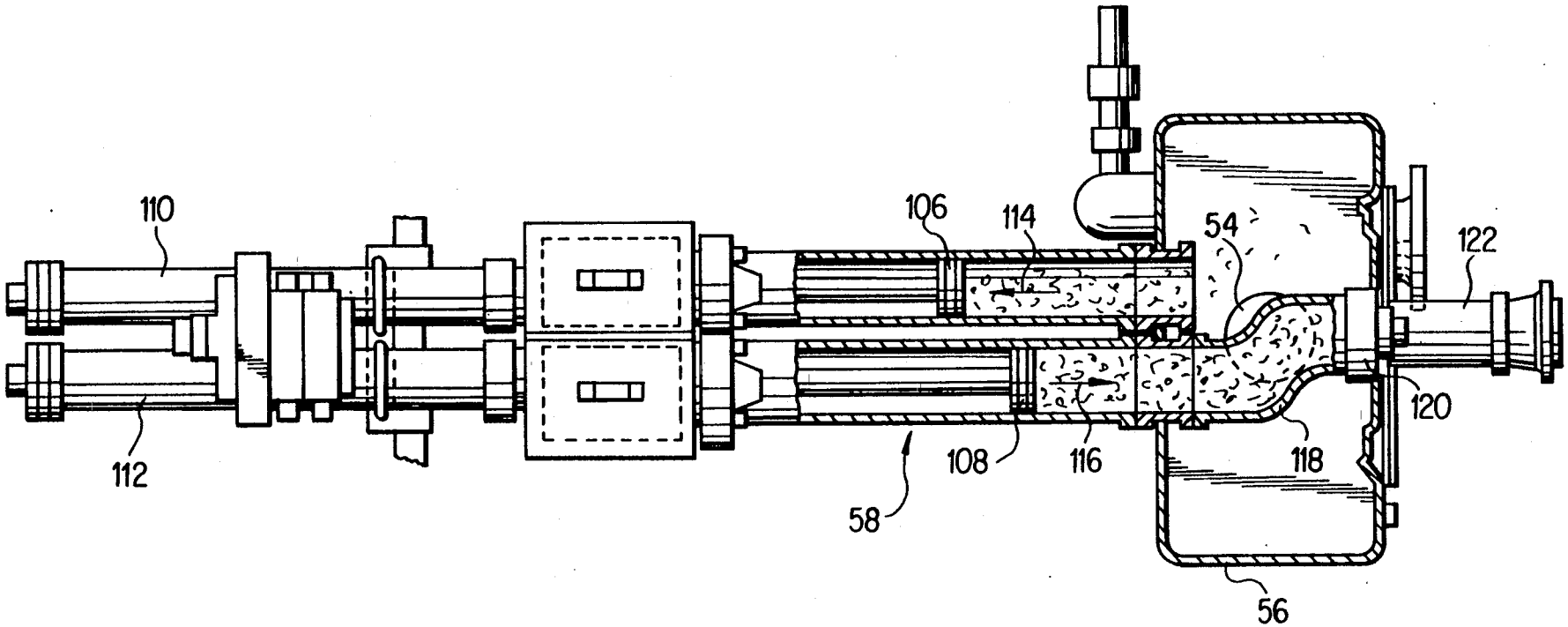
Figure 7B:
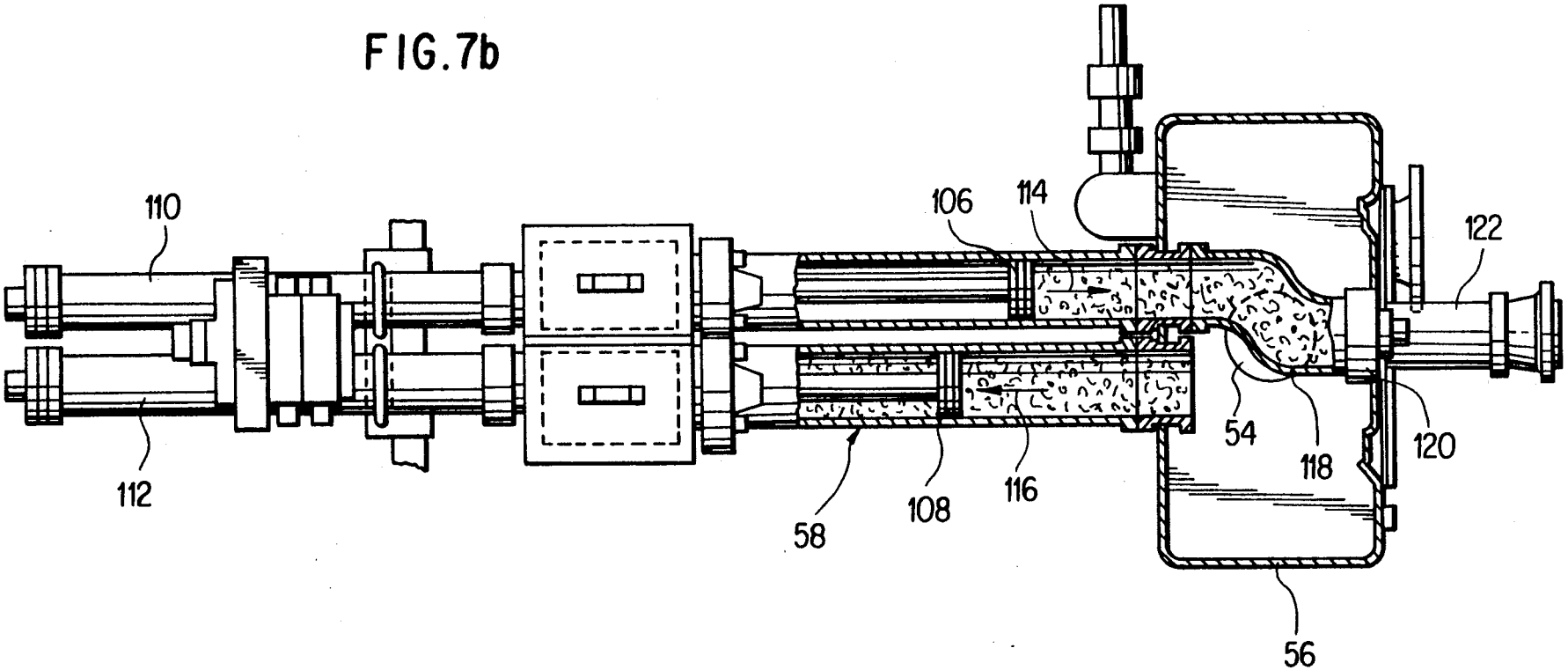

Referring now to FIGS. 5, 6 and 7*a* and *b* the double acting positive displacement sludge pump 58 is of known construction and comprises a pair of pump pistons 106, 108 (FIG. 7*a* and *b*) which are operated in opposite directions by hydraulic cylinders 110, 112 whereby when one pump piston, say piston 106, is being retracted in the direction of arrow 114 to receive in its cylinder dredged material being crowded into the pump inlet chamber 56 by the feed screw 48 (FIGS. 5 and 6) the other piston 108 is being extended in the direction of arrow 116 to drive the charge of material previously received in its cylinder into an oscillatable goose-necked conduit 118 whose inlet end is moved by suitable linkage (not shown) in a coordinated manner with the hydraulic cylinders 110, 112 from outlet, as shown in FIG. 7*a*, to the other, as shown in FIG. 7*b*, pump pistons 106, 108. The outlet of the goose-necked conduit has a swivel connection 120 with the inlet of a ladder-carried dredge pipe 122 having a conventional swivel connection 124 with the remainder 126 of the dredge pipe leading from the barge 10 to a remote disposal site.

Figure 4:
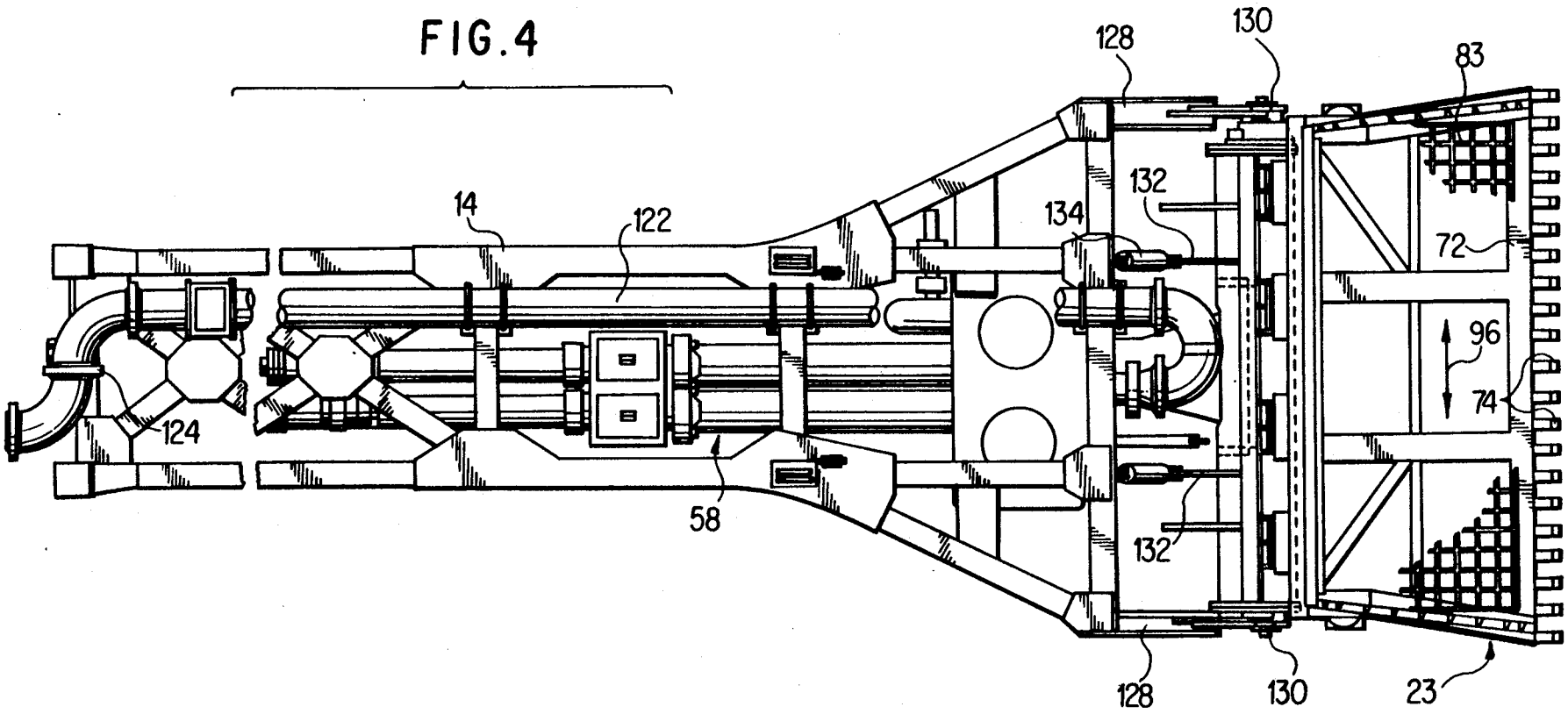
FIG. 4 is a top plan view of the ladder of FIG. 3.

As best seen in FIGS. 4 and 5 the outer end of the ladder is provided with a pair of laterally spaced arms 128 which pivotally journal stub shafts 130 carried by the side walls 26, 28 of the shroud 24. Extending rearwardly from the shroud are a pair of laterally spaced fins 132 (FIGS. 4 and 8) each pivotally receiving one end of a pair of hydraulic cylinders 134 whose opposite ends are pivotally connected to the ladder. When the ladder is lowered to its working position of FIG. 1, the hydraulic cylinders 134 are extended as necessary to ensure that the dredge module is tilted to a substantially level operating position relative to the ladder.

Because the flared inlet 44 of the feed screw transfer passage 46 extends into the shroud itself as best seen in FIG. 5, in order to enable the module to be tilted relative to the ladder and transfer passage, the closed rear wall of the shroud is slotted as at 136 in FIG. 5, and welded to the exterior of the flared part 44 of the transfer passage is an arcuate plate 138 concentric with the rear wall 30 of the shroud and which interiorly covers the slot 136 for the maximum range of movement of the module 18 from its position of FIG. 6 to its upper dotted line position 18' as shown in FIG. 1.

In operation, the dredge barge 10 is suitably positioned for straight ahead movement. It may have side sheaves (not shown) receiving parallel lines (not shown) anchored ahead of and to the rear of the barge and acting as guide lines to restrain the barge from sluing as it advances into the tar pond. The forward advance of the barge may be controlled by a line 140 (FIG. 1) leading from a winch 142 to an anchor (not shown) secured ahead of the barge. Prior to the initial cut the ladder is lowered to a position where the module will enter the material to be dredge substantially entirely beneath the surface 146 of the material as shown in FIG. 1. The vibrators 86 are energized to vibrate the frame laterally to assist in this and to break off small substantially solid undissolved pieces of the material being dredged while the barge is advanced forwardly. As the module is moved the chunks enter the frame through the screens 83, 84 until the frame is filled with broken chunks of the material being dredged. That state is determined by suitable sensors (not shown). As the barge continues to advance the material in the frame is crowded against the auger blades 36, 38 at which point the dredge operator in the control house 144 on the barge energizes the auger shaft 34 to force by the auger blades 36, 38 material crowded against them to the central region 42 of the shroud. At this point the dredged material being moved in the module has a maximum solids concentration due to the fact that the module, being substantially submerged in the material being dredged, is substantially sealed by that material from the ingress of water disposed in the region being dredged. As the material is driven towards the central region, the blade spokes 39 aid in comminuting or pulverizing the chunks to a size which can be handled by the positive displacement pump 58. The pulverized material reaching the central region 42 of the shroud and transferred therefrom by the feed screw 48 is in a fluidic or flowable condition while being mostly solid which is suitable for pumping only by a positive displacement pump such as pump 58. Other pumping means, such as a centrifugal dredge pump would not be able to transport such a high solids concentration to a remote site. In accordance with the invention the comminuted dredged material is delivered by the feed screw 48 to the inlet chamber 56 of the pump 58 at a rate 40 to 50% greater than the capacity of the sludge pump. The material thus crowded into the inlet chamber 56 is compressed to positively feed the intake of the positive displacement pump.

The module will make several passes through the material each time being lowered to a depth wherein during dredging the module is substantially covered by the material being dredged. After all but a shallow layer of the material has been dredged in one path the barge will be laterally repositioned and will continue this process until only a shallow layer of sediment remains over the entire bottom. At this point and with reference to FIG. 10, the ladder is elevated to its fully raised position and the hydraulic cylinders 134 for controlling the angle of the dredge module with respect to the ladder are disconnected from the rearwardly extending fins 132 and are replaced by counterweights 146 connected to the module by a rod 148 passing through the holes in the fins 132. The weights ar selected to counterbalance the module in a manner enabling it to follow the contours of the bottom as it collects the final shallow layer. This is known as the clean-up mode of the module.

It will be understood that load, pressure, and position sensors (not shown) are provided to display to the operator in the control house 144 all the information he requires to ensure efficient operation of the dredge. For example a pressure sensor in the pump inlet chamber 56 indicates the rate of delivery of material thereto and removal therefrom and if there is excessive difference, the operator controls the rotational speed of the feed screw so that movement in and out of the chamber is in step. The module is submerged in the material being dredged in order to minimize turbidity. A submergence sensor (not shown) aids in ensuring that the module is submerged to a depth which minimizes turbidity while maximizing solids movement through the screens and into engagement with the auger. Though the nature of the material being dredged may make it desirable to occlude some of the areas of the screens through which material may pass into the frame this may be particularly important in the clean-up mode where it is desirable to retain turbidity as much as possible within the module. Thus in the clean-up mode, the upper screen may be as much as 90% occluded as shown schematically in FIG. 10, by a plate 150 bolted to the upper edges of the side plates as schematically shown in FIG. 10. With the upper screen about 90% closed off, it may be desirable to close about 10% of the lower screen shown schematically by the plate 152 in FIG. 10.

It should be apparent that the invention is susceptible of a variety of changes and modifications without, however, departing from the scope and spirit of the appended claims.

What is claimed as new and desired to be secured by Letters Patent of the United States is:

1. In dredging apparatus of the type including auger means rotatably enclosed in a shroud having transversely spaced end walls, a substantially closed rear wall, and an open front face, said auger means being constructed and arranged to deliver dredged material to a central region of said shroud, and transfer means communicating with said central region to convey material delivered thereto by said auger means to a location remote from said apparatus, in combination therewith a wedge shaped digger frame having laterally spaced side walls, an open rear face of substantially the same size as the open front face of said shroud, and upper and lower forwardly converging faces terminating at their forward ends in a laterally extending cutting edge, at least the upper face of said frame being open, a screen over said open face constructed to permit dredged particles to enter said frame, vibration damping means connecting said frame to said shroud with their respective open faces in substantial registry, and means carried by said frame for vibrating it during use relative to said shroud.

2. In the dredging apparatus of claim 1 wherein said vibrating means is constructed and arranged to vibrate said frame transversely with respect to said shroud.

3. In the dredging apparatus of claim 1 wherein both said upper and lower faces are open and include screen means over both of said faces.

4. In the dredging apparatus of claim 3 including means for partially covering at least the screen means over said upper face.

5. In the dredging apparatus of claim 1 including transversely spaced forwardly extending teeth fixed to said cutting edge.

6. In the dredge apparatus of claim 1 wherein said vibration damping means comprises confronting flanges on said shroud and on said frame, a plurality of spaced apertures through each of said flanges normal to the plane thereof and, coil spring means screwed into the apertures of the respective confronting flanges generally parallel to said flanges.

7. In the dredging apparatus of claim 6 wherein there are a plurality of horizontally spaced, confronting flanges in horizontal disposition along upper and lower edges of said shroud and said frame, respectively, said coil springs being screwed horizontally into said apertures of each pair of said confronting flanges.

8. In the dredging apparatus of claim 1 including a dredge barge, a dredge ladder pivotally connected at one end to said dredge barge, means pivotally connecting said shroud to the opposite end of said ladder, and means for selectively adjusting the angular position of said shroud and frame with respect to said ladder.

9. In the dredging apparatus of claim 8 wherein said auger means includes an auger shaft rotatably journaled in said end walls of said shroud, a pair of oppositely threaded auger blades on said shaft, and power means carried by said shroud for rotating said auger shaft in a direction to deliver dredged material by said auger blades to said central region of said shroud.

10. In the dredging apparatus of claim 1 wherein said transfer means comprises an auger conveyor and said remote location comprises the inlet chamber of a positive displacement double acting sludge pump.

11. In the dredging apparatus of claim 10 wherein said auger conveyor has a transfer capacity about 85% greater than the capacity of said positive displacement pump to ensure that a maximum concentration of solids is delivered to said positive displacement pump.

12. In the dredging apparatus of claim 11 wherein at least a part of each of said auger blades is connected to said shaft by radially extending circumferentially and helically spaced spokes.

13. In the dredging apparatus of claim 10 wherein said means for selectively adjusting the angular position of said shroud and frame relative to said ladder includes means for releasing said adjusting means from said shroud and frame, and means for releasably connecting weight means to said shroud of a size to counter balance the weight of said frame whereby the angular position of said shroud and frame relative to said ladder is controlled by the force of gravity.

* * * * *